US009618291B1

(12) United States Patent
Henderson

(10) Patent No.: US 9,618,291 B1
(45) Date of Patent: Apr. 11, 2017

(54) GUN REST SYSTEM

(71) Applicant: Bryan Henderson, Mount Morris, PA (US)

(72) Inventor: Bryan Henderson, Mount Morris, PA (US)

( * ) Notice: Subject to any disclaimer, the term of this patent is extended or adjusted under 35 U.S.C. 154(b) by 0 days.

(21) Appl. No.: 14/927,195

(22) Filed: Oct. 29, 2015

(51) Int. Cl.
*F41A 23/02* (2006.01)

(52) U.S. Cl.
CPC ..... *F41A 23/02* (2013.01)

(58) Field of Classification Search
CPC ..... F41A 23/00; F41A 23/02; F41A 23/16; F41A 23/18; F16M 13/04; A45F 2200/0591; A63B 2071/026; A47B 81/005; B60R 7/14
USPC ..... 42/94; 89/37.04
See application file for complete search history.

(56) References Cited

U.S. PATENT DOCUMENTS 3,233,517 A * 2/1966 Morrison ..... F41A 23/12 248/166
5,067,268 A 11/1991 Ransom
5,173,563 A 12/1992 Gray
5,332,185 A * 7/1994 Walker, III ..... F41A 23/02 248/346.2
5,628,135 A 5/1997 Cady
5,811,720 A * 9/1998 Quinnell ..... F41A 23/16 42/94
5,875,580 A * 3/1999 Hill ..... F41A 23/02 42/94
6,035,572 A * 3/2000 Goode, Jr. ..... A45B 5/00 42/94
6,253,482 B1 * 7/2001 Peterson ..... F41A 23/02 42/94
6,367,466 B1 4/2002 Nettles, Jr.
D471,248 S 3/2003 Jacobs
8,245,432 B2 * 8/2012 Letson ..... F41A 23/16 42/94
8,683,730 B1 4/2014 Moore
2002/0111233 A1 * 8/2002 Lloyd ..... A63B 69/0091 473/429
2005/0115137 A1 6/2005 Minneman
2007/0052178 A1 * 3/2007 Cottrell ..... A63B 63/00 273/402
2007/0074439 A2 * 4/2007 Cauley ..... F41A 23/16 42/94
2008/0127815 A1 * 6/2008 Yale ..... F41C 33/06 89/37.01
2014/0182185 A1 7/2014 White

FOREIGN PATENT DOCUMENTS

WO WO2011060481 5/2011

* cited by examiner

*Primary Examiner* — Bret Hayes

(57) ABSTRACT

A gun rest system includes a weighted substance and a rifle. A mount is provided and the rifle is positioned on the mount thereby facilitating the mount to restrain the rifle. The mount is substantially hollow such that a selected amount of the weighted substance is positionable within the mount. Thus, the mount absorbs recoil from the rifle when the rifle is fired.

12 Claims, 5 Drawing Sheets

GUN REST SYSTEM

BACKGROUND OF THE DISCLOSURE

Field of the Disclosure

The disclosure relates to gun devices and more particularly pertains to a new gun device for supporting a rifle and absorbing recoil from the rifle.

SUMMARY OF THE DISCLOSURE

An embodiment of the disclosure meets the needs presented above by generally comprising a weighted substance and a rifle. A mount is provided and the rifle is positioned on the mount thereby facilitating the mount to restrain the rifle. The mount is substantially hollow such that a selected amount of the weighted substance is positionable within the mount. Thus, the mount absorbs recoil from the rifle when the rifle is fired.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
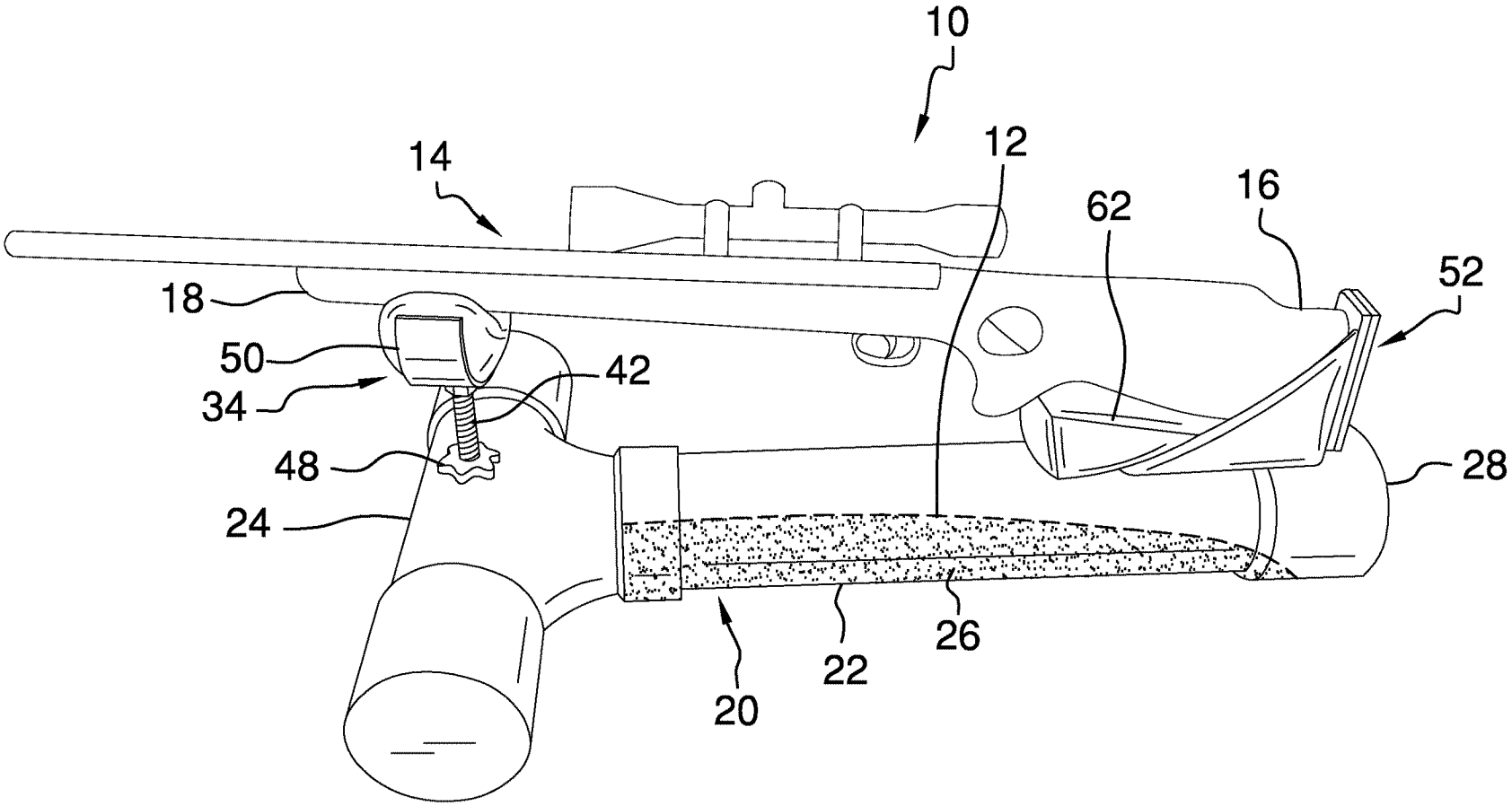
FIG. 1 is a perspective in-use view of a gun rest system according to an embodiment of the disclosure.
Figure 2:
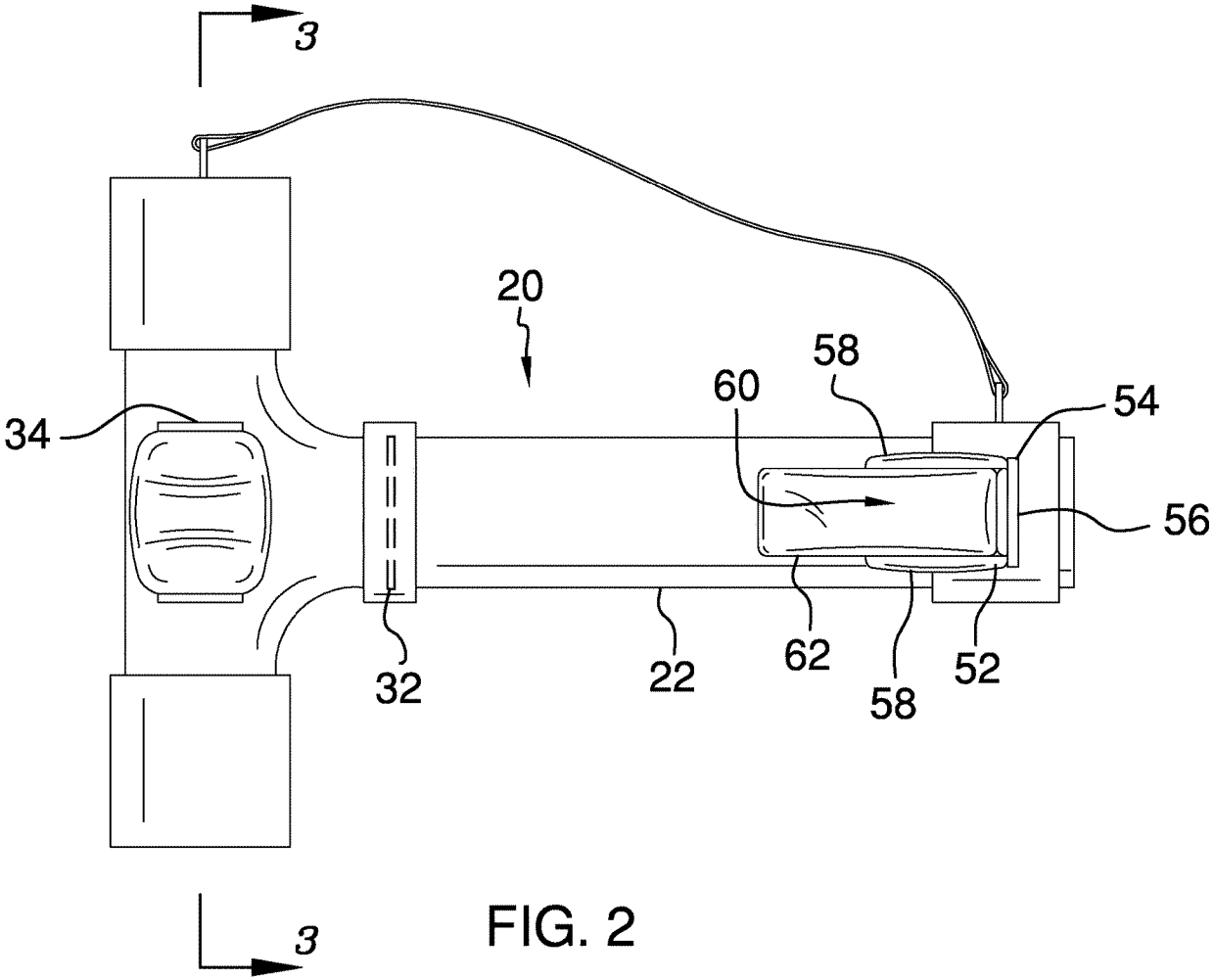
FIG. 2 is a top view of an embodiment of the disclosure.
Figure 3:
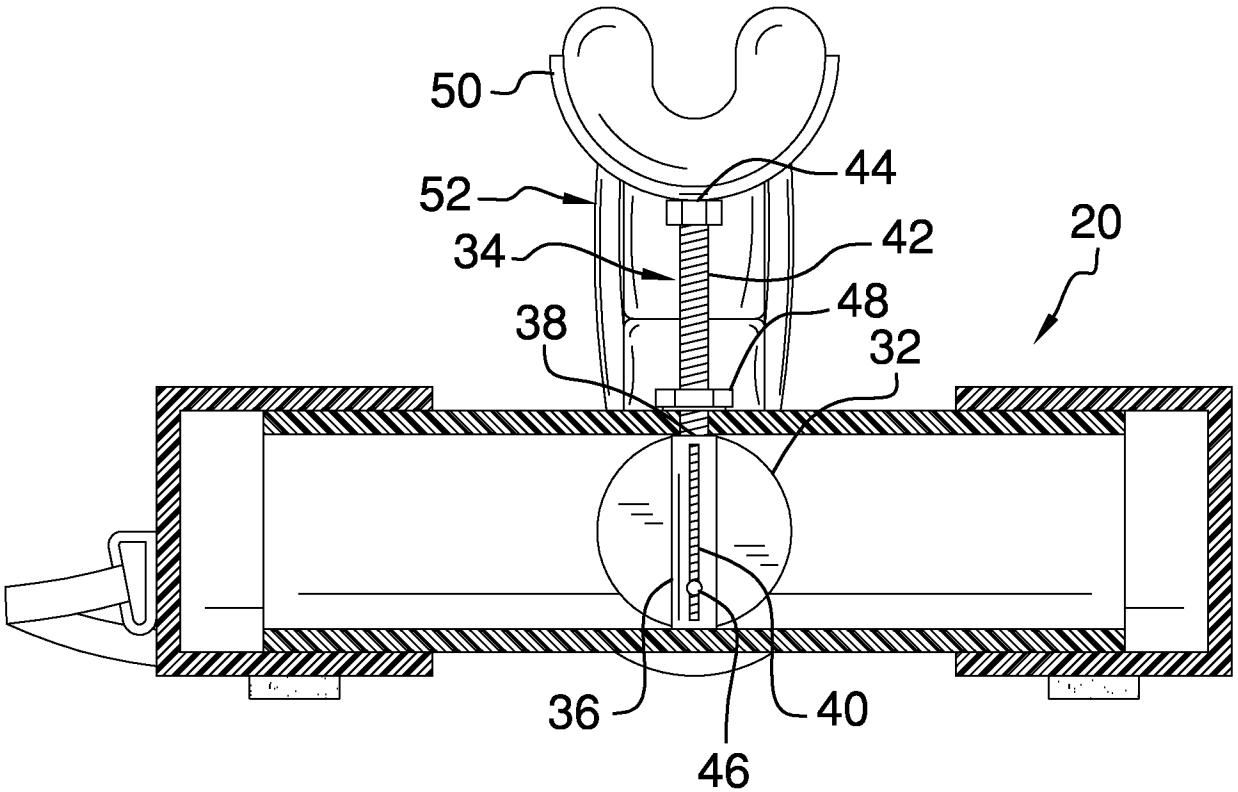
FIG. 3 is a cross sectional view taken along line 3-3 of FIG. 2 of an embodiment of the disclosure.
Figure 4:
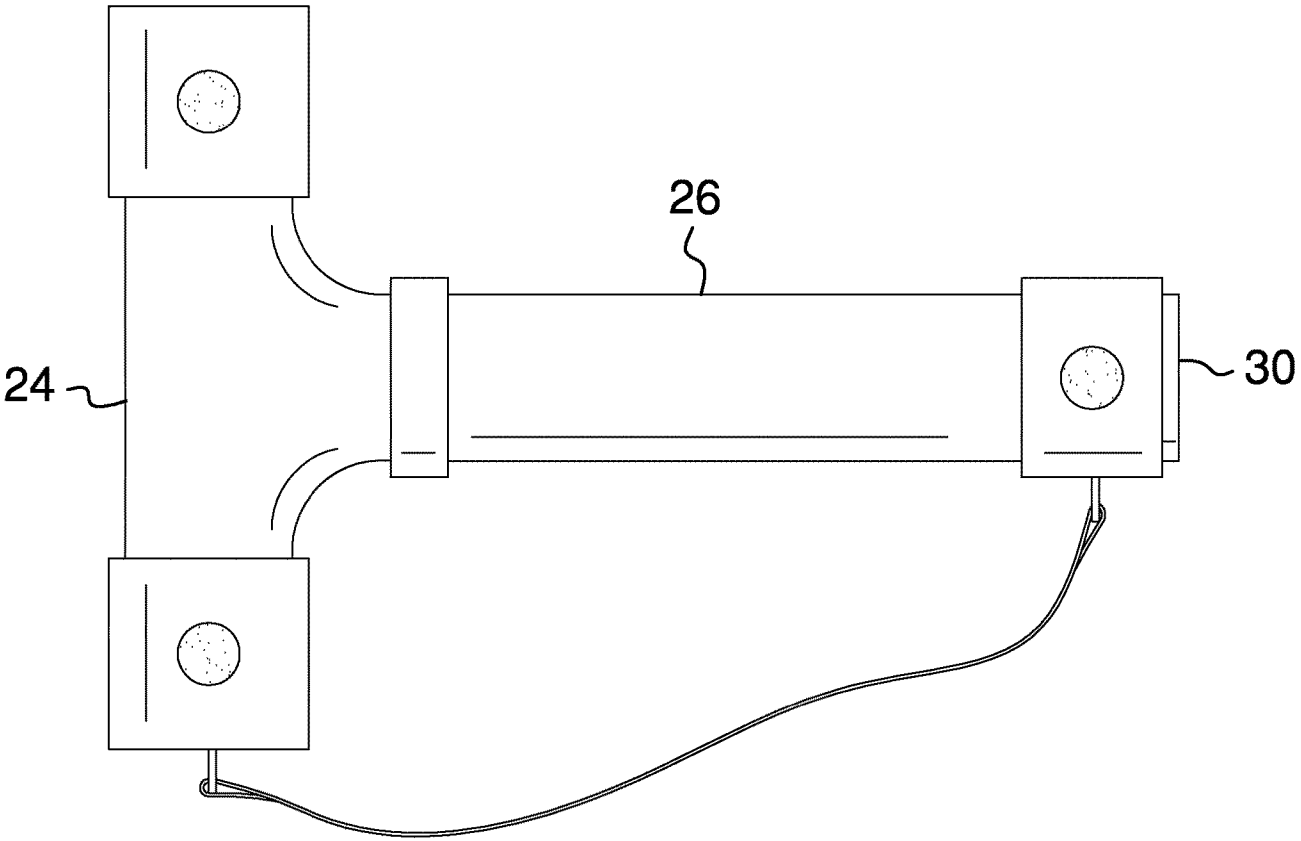
FIG. 4 is a bottom view of an embodiment of the disclosure.
Figure 5:
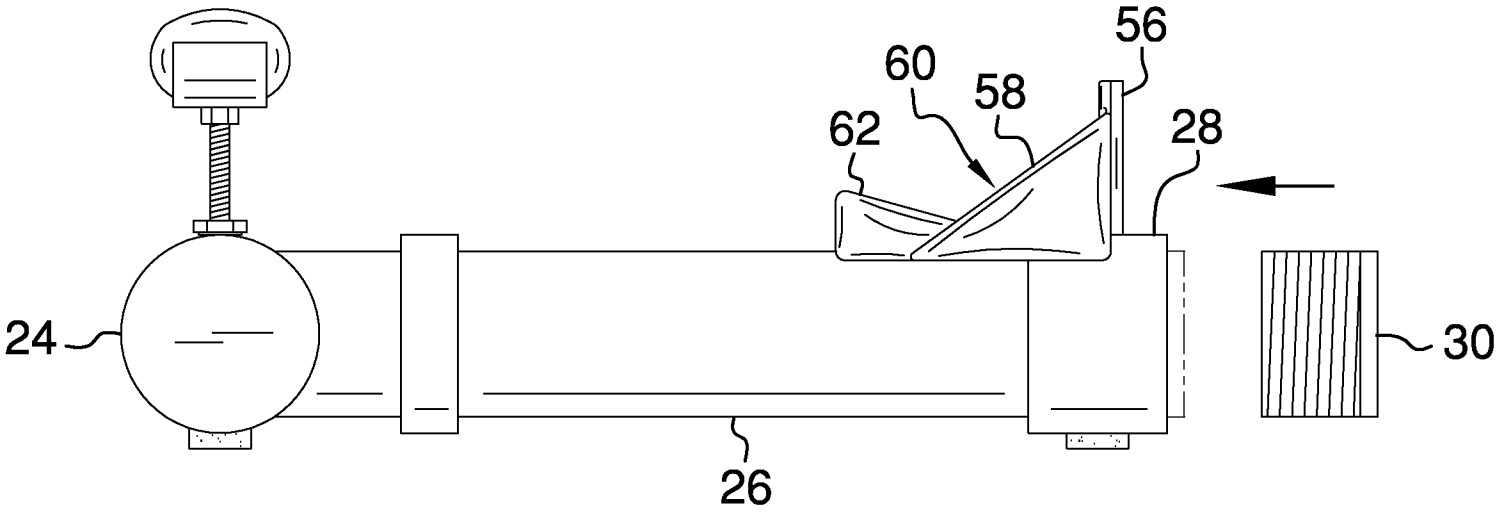
FIG. 5 is a left side view of an embodiment of the disclosure.

With reference now to the drawings, and in particular to FIGS. 1 through 5 thereof, a new gun device embodying the principles and concepts of an embodiment of the disclosure and generally designated by the reference numeral 10 will be described.

As best illustrated in FIGS. 1 through 5, the gun rest system 10 generally comprises a weighted substance 12. The weighted substance 12 may comprise sand or the like. A rifle 14 is provided and the rifle 14 has a butt 16 and a stock 18. The rifle 12 may be a rifle of any conventional design including, but not being limited to, a bolt action rifle or the like.

A mount 20 is provided and the rifle 14 is positioned on the mount 20 thereby facilitating the mount 20 to restrain the rifle 14. The mount 20 is substantially hollow such that a selected amount of the weighted substance 12 is positionable within the mount 20. Thus, the mount 20 may absorb recoil from the rifle 14 when the rifle 14 is fired.

The mount 20 comprises a tube 22 that has a first arm 24 and a second arm 26. The first arm 24 intersects the second arm 26 such that the tube 22 is T-shaped. The second arm 26 has a distal end 28 with respect to the first arm 24. The distal end 28 is open thereby facilitating the selected amount of weighted substance 12 to be positioned within the second arm 26. The selected amount of weighted substance 12 may have a weight ranging between approximately one half kg and two kg.

A cap 30 is removably coupled to the distal end 28. The cap 30 retains the weighted substance 12 within the tube 22. A disk 32 is positioned within the second arm 26 and the disk 32 is positioned proximate an intersection of the first arm 24 and the second arm 26. The disk 32 closes an intersection of the first arm 24 and the second arm 26. Thus, the disk 32 prevents the weighted substance 12 from entering the first arm.

A front rest 34 is coupled to the first arm 24 such that the front rest 34 supports the stock 18 when the rifle 14 is positioned on the mount 20. The front rest 34 comprises a sleeve 36 that is fixedly positioned within the first arm 24 such that the sleeve 36 is vertically oriented. The sleeve 36 may be coupled to the first arm 24 or the sleeve 36 may be an integral component of the first arm 24. The sleeve 36 has a top end 38 and the top end 38 is open. The sleeve 36 has a slot 40 extending therethrough. The slot 40 extends substantially between the first arm 24 and the top end 38.

A rod 42 extends through the first arm 24. The rod 42 extends into the top end 38 of the sleeve 36 such that the rod 42 is vertically oriented. The rod 42 has a distal end 44 with respect to the first arm 24. A pin 46 extends through the slot 40 and engages the rod 42 such that the rod 42 is inhibited from rotating within the sleeve 36. The sleeve 36 inhibits the rod 42 from deflecting laterally or longitudinally with respect to the first arm 24.

A stop 48 threadably engages the rod 42 such that the stop 48 is positionable at a selected point along the rod 42. The stop 48 engages the first arm 24 such that distal end 44 of the rod 42 is spaced a selected distance from the first arm 24. A saddle 50 is coupled to the distal end 44 of the rod 42. The saddle 50 supports the stock 18 when the rifle 14 is positioned on the mount 20.

A back rest 52 is coupled to the second arm 26 and the back rest 52 is aligned with the front rest 34. The back rest 52 supports the butt 16 when the rifle 14 is positioned on the mount 20. The back rest 52 comprises a retainer 54 that has a first wall 56 and a pair of lateral walls 58. Each of the lateral walls 58 is coupled to and extends away from the first wall 56. The lateral walls 58 are spaced apart from each other to define a butt space 60 between the lateral walls 58.

The retainer 54 is coupled to and extends upwardly from the second arm 26. The retainer 54 is positioned adjacent to the distal end 28 of the second arm 26. The butt 16 is positioned within the butt space 60 when the rifle 14 is positioned on the mount 20. The first wall 56 restricts rearward motion of the rifle 14 with respect to the mount 20. Each of the lateral walls 58 inhibits the rifle 14 from tipping laterally when the rifle 14 is positioned on the mount 20.

A cushion 62 is positioned on the second arm 26. The cushion 62 is positioned within the butt space 60 such that the cushion 62 supports the butt 16 when the rifle 14 is positioned on the mount 20. The cushion 62 extends forwardly from the retainer 54. The cushion 62 may comprise a sand bag or the like.

In use, the cap 30 is removed and the selected amount of weighted substance 12 is positioned within the second arm 26. The cap 30 is replaced on the second arm 26. The mount 20 is positioned on a support surface 64 such as a table or the like. The support surface 64 may be utilized in the convention of shooting range support surfaces. The rifle 14 is positioned within the saddle 50 and the retainer 54. The stop 48 is manipulated to adjust an aim of the rifle 14 while the rifle 14 is on the mount 20. The rifle 14 is fired while the rifle 14 is positioned within the mount 20. The weighted substance 12 facilitates the mount 20 to absorb recoil of the rifle 14 when the rifle 14 is fired.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A gun rest system comprising:

a weighted substance;

a rifle;

a mount having said rifle being positioned thereon thereby facilitating said mount to restrain said rifle, said mount being substantially hollow such that a selected amount of said weighted substance is positionable within said mount thereby facilitating said mount to absorb recoil from said rifle when said rifle is fired; and wherein said mount comprises a tube having a first arm and a second arm, said first arm intersecting said second arm such that said tube is T-shaped, said second arm having a distal end with respect to said first arm, said distal end being open such that said selected amount of weighted substance is positioned within said second arm.

2. The system according to claim 1, further comprising:

a cap being removably coupled to said distal end, said cap retaining said selected amount of weighted substance within said tube; and a disk being positioned within said second arm, said disk being positioned proximate an intersection of said first arm and said second arm such that said disk prevents said weighted substance from entering said first arm.

3. The system according to claim 1, further comprising:

said rifle having a stock; and a front rest being coupled to said first arm such that said front rest supports said stock when said rifle is positioned on said mount.

4. The system according to claim 3, wherein said front rest comprises a sleeve being fixedly positioned within said first arm such that said sleeve is vertically oriented, said sleeve having a top end, said top end being open, said sleeve having a slot extending therethrough, said slot extending substantially between said first arm and said top end.

5. The system according to claim 4, further comprising:

a rod extending through said first arm, said rod extending into said top end of said sleeve such that said rod is vertically oriented, said rod having a distal end with respect to said first arm; and a pin extending through said slot and engaging said rod such that said rod is inhibited from rotating within said sleeve.

6. The system according to claim 4, further comprising a stop threadably engaging said rod such that said stop is positionable at a selected point along said rod, said stop engaging said first arm such that distal end of said rod is spaced a selected distance from said first arm.

7. The system according to claim 5, further comprising a saddle being coupled to said distal end of said rod, said saddle having said stock being positioned thereon.

8. The system according to claim 1, further comprising:

said rifle having a butt; and a back rest being coupled to said second arm, said back rest being aligned with said front rest, said back rest supporting said butt when said rifle is positioned on said mount.

9. The system according to claim 8, wherein said back rest comprises a retainer having a first wall and a pair of lateral walls, each of said lateral walls being coupled to and extending away from said first wall, said lateral walls being spaced apart from each other to define a butt space between said lateral walls.

10. The system according to claim 9, wherein said retainer is coupled to and extends upwardly from said second arm, said retainer being positioned adjacent to said distal end of said second arm such that said butt is positioned within said butt space when said rifle is positioned on said mount, said first wall restricting rearward motion of said rifle with respect to said mount.

11. The system according to claim 9, further comprising a cushion being positioned on said second arm, said cushion being positioned within said butt space such that said cushion supports said butt when said rifle is positioned on said mount, said cushion extending forwardly from said retainer.

12. A gun rest system comprising:

a weighted substance;

a rifle having a butt and a stock; and a mount having said rifle being positioned thereon thereby facilitating said mount to restrain said rifle, said mount being substantially hollow such that a selected amount of said weighted substance is positionable within said mount thereby facilitating said mount to absorb recoil from said rifle when said rifle is fired, said mount comprising:

a tube having a first arm and a second arm, said first arm intersecting said second arm such that said tube is T-shaped, said second arm having a distal end with respect to said first arm, said distal end being open such that said selected amount of weighted substance is positioned within said second arm, a cap being removably coupled to said distal end, said cap retaining said selected amount of weighted substance within said tube, a disk being positioned within said second arm, said disk being positioned proximate an intersection of said first arm and said second arm such that said disk prevents said weighted substance from entering said first arm, a front rest being coupled to said first arm such that said front rest supports said stock when said rifle is positioned on said mount, said front rest comprising:

a sleeve being fixedly positioned within said first arm such that said sleeve is vertically oriented, said sleeve having a top end, said top end being open, said sleeve having a slot extending therethrough, said slot extending substantially between said first arm and said top end, a rod extending through said first arm, said rod extending into said top end of said sleeve such that said rod is vertically oriented, said rod having a distal end with respect to said first arm, a pin extending through said slot and engaging said rod such that said rod is inhibited from rotating within said sleeve, a stop threadably engaging said rod such that said stop is positionable at a selected point along said rod, said stop engaging said first arm such that distal end of said rod is spaced a selected distance from said first arm, and a saddle being coupled to said distal end of said rod, said saddle having said stock being positioned thereon; and a back rest being coupled to said second arm, said back rest being aligned with said front rest, said back rest supporting said butt when said rifle is positioned on said mount, said back rest comprising:

a retainer having a first wall and a pair of lateral walls, each of said lateral walls being coupled to and extending away from said first wall, said lateral walls being spaced apart from each other to define a butt space between said lateral walls, said retainer being coupled to and extending upwardly from said second arm, said retainer being positioned adjacent to said distal end of said second arm such that said butt is positioned within said butt space when said rifle is positioned on said mount, said first wall restricting rearward motion of said rifle with respect to said mount, and a cushion being positioned on said second arm, said cushion being positioned within said butt space such that said cushion supports said butt when said rifle is positioned on said mount, said cushion extending forwardly from said retainer.

* * * * *